US010751905B2

(12) United States Patent
Fuchs et al.

(10) Patent No.: US 10,751,905 B2
(45) Date of Patent: Aug. 25, 2020

(54) WEIGHT-REDUCED GUIDE BAR OF SOLID MATERIAL

(71) Applicant: Andreas Stihl AG & Co. KG, Waiblingen (DE)

(72) Inventors: Alexander Fuchs, Bietigheim-Bissingen (DE); Michael Leiter, Korb (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 14/968,650

(22) Filed: Dec. 14, 2015

(65) Prior Publication Data

US 2016/0096284 A1 Apr. 7, 2016

Related U.S. Application Data

(63) Continuation of application No. 12/929,642, filed on Feb. 7, 2011, now abandoned.

(30) Foreign Application Priority Data

Feb. 6, 2010 (DE) ..... 10 2010 007 081

(51) Int. Cl.
*B27B 17/02* (2006.01)

(52) U.S. Cl.
CPC ..... *B27B 17/025* (2013.01)

(58) Field of Classification Search
CPC ..... B27B 17/025; B27B 17/02
USPC ..... 30/381–387
See application file for complete search history.

(56) References Cited

U.S. PATENT DOCUMENTS 2,635,165 A * 4/1953 Spice ..... B23K 9/125 219/137.71
2,748,810 A 6/1956 Strunk
3,416,578 A * 12/1968 Irgens ..... B27B 17/025 29/463
3,485,276 A * 12/1969 Font ..... B23D 65/00 83/821
4,393,590 A 7/1983 Pantzar
4,430,795 A 2/1984 Wetzel et al.
(Continued)

FOREIGN PATENT DOCUMENTS

DE 203 15 680 U1 1/2004
DE 20 2004 017 854 U1 3/2005
(Continued)

OTHER PUBLICATIONS

Zaccone, M.A. & Krauss, G. MTA (1993) 24: 2263. https://doi.org/10.1007/BF02648600.*
(Continued)

*Primary Examiner* — Jonathan G Riley
(74) *Attorney, Agent, or Firm* — Walter Ottesen, P.A.

(57) ABSTRACT

A guide bar (1) for the saw chain (2) of a motor-driven chain saw includes a longitudinal bar base body (3) of solid material having a reversal section (5) and a mounting section (8). A weight recess (11) is formed in a flat side (13) of the bar base body (3). The weight recess (11) extends essentially along the bar base body (3) and is closed by a cover plate (12). A light-weight, torsion-resistant guide bar is produced in that a longitudinal rib (14, 15) supporting the cover plate (12) is arranged in the weight recess (11) and extends in the longitudinal direction (19) of the guide bar (1).

11 Claims, 2 Drawing Sheets

(56) References Cited

U.S. PATENT DOCUMENTS 4,641,432 A * 2/1987 Kume ..... B27B 17/025 219/121.64
4,794,696 A * 1/1989 Apfel ..... B27B 17/025 30/383
4,961,263 A * 10/1990 Apfel ..... B27B 17/025 30/383
4,965,934 A * 10/1990 Eriksson ..... B27B 17/025 30/383
5,025,561 A 6/1991 Sugihara et al.
5,155,323 A * 10/1992 Macken ..... B23K 26/0608 219/121.63
5,503,913 A * 4/1996 Konig ..... C23C 16/403 427/255.31
5,561,908 A * 10/1996 Leini ..... B27B 17/02 30/381
5,596,811 A * 1/1997 Payne ..... A01G 23/091 30/383
5,669,140 A 9/1997 Tsumura
6,098,436 A * 8/2000 Girardello ..... C23C 22/12 72/254
6,109,821 A * 8/2000 Montalbano ..... E01F 9/553 116/63 R
6,397,475 B1 6/2002 Pettersson et al.
6,427,342 B1 * 8/2002 Breitbarth ..... B27B 17/025 30/383
6,698,101 B2 3/2004 Chen
6,964,101 B2 11/2005 Graves et al.
8,316,723 B2 11/2012 Mol et al.
2003/0167642 A1 * 9/2003 Chen ..... B27B 17/025 30/387
2004/0111897 A1 * 6/2004 Graves ..... B27B 17/025 30/387
2005/0205171 A1 9/2005 Nakamyou
2008/0178478 A1 * 7/2008 Chang ..... B27B 17/025 30/383
2010/0037472 A1 * 2/2010 Lucas ..... B27B 17/02 30/383
2010/0251810 A1 * 10/2010 Mol ..... F16C 33/62 73/114.81
2014/0250701 A1 * 9/2014 Amend ..... B27B 17/025 30/383

FOREIGN PATENT DOCUMENTS

EP 0 503 840 A1 9/1992
JP 406297403 A 10/1994
JP 406297404 A 10/1994

OTHER PUBLICATIONS

Milberg, J. et al, "Defect-free joining of zinc-coated steels by bifocal hybrid laser welding", Prod.Eng.Res.Devel. (2009), 3, German Academic Society for Production Engineering (WGP), pp. 9 to 15.

* cited by examiner

WEIGHT-REDUCED GUIDE BAR OF SOLID MATERIAL

CROSS REFERENCE TO RELATED APPLICATIONS

This is a continuation application of U.S. patent application Ser. No. 12/929,642, filed Feb. 7, 2011, and claims priority of German patent application no. 10 2010 007 081.5, filed Feb. 6, 2010, and the entire contents of both are incorporated herein by reference.

FIELD OF THE INVENTION

The invention relates to a guide bar for the saw chain of a motor-driven chain saw which includes an elongated bar base body made of solid material.

BACKGROUND OF THE INVENTION

U.S. Pat. No. 4,794,696 discloses a solid-material guide bar whose base body has openings for weight reduction. These openings are closed by cover plates which lie flush on the corresponding flat sides of the guide bar base body. In order to ensure sufficient stability, the cover plates must be precisely adapted to, inserted in, and fixed to the countersinks of the openings. This involves high production costs.

SUMMARY OF THE INVENTION

It is an object of the invention to develop a guide bar of solid material with weight recesses in such a manner that a simple and precise production with high stiffness of the guide bar is ensured.

The guide bar of the invention is for a saw chain of a motor driven chain saw. The guide bar includes: an elongated bar base body of solid material having a first end and a second end; a direction reversal section for the saw chain and the direction reversal section being arranged at the first end of the bar base body; a mounting section for fixating the guide bar and the mounting section being arranged at the second end; the bar base body defining an edge and having a flat side; a guide groove formed in the edge of the bar base body and being configured to guide the saw chain; a weight recess formed in the flat side of the bar base body and extending essentially along the bar base body between the mounting section and the reversal section; a cover plate for closing the weight recess; and, the weight recess having a longitudinal rib arranged therein for supporting the cover plate and the longitudinal rib extending in the longitudinal direction of the bar base body.

According to an embodiment of the invention, the weight recess opens to only one flat side of the guide bar base body, so that processing is required only on one side of the base body of the bar. The weight recess extends between the mounting section of the guide bar and the reversal section of the guide bar. A longitudinal rib, which supports a cover plate, is arranged in the weight recess. In this way, the cover plate is supported transversely to the longitudinal direction of the guide bar thereby ensuring high dimensional stability.

The longitudinal rib extends from one end of the weight recess to the other end of the weight recess and partitions the weight recess into component recesses. Thus, a plurality of recesses, which extend over the length of the guide bar base body, lie next to each other transversely to the longitudinal direction of the guide bar base body. This increases the connection stiffness of the weight-reduced guide bar of solid material.

The cover plate lies flush in a plane with the flat side of the guide bar base body. For this purpose, the cover plate is set in a countersink of the weight recess. The cover plate lies in the countersink in such a manner that its edge forms a gap with the peripheral edge of the weight recess. A connecting seam fixing the cover plate to the guide bar base body is accommodated in this gap. Preferably, this is done via a weld seam, in particular a bifocal laser weld seam. In this welding process two laser welding beams which are at a distance to each other are directed at the material and the edges (peripheral edge of the weight recess and the edge of the cover plate) are liquified so that the gap fills. Such a welding device is disclosed in DE 20 2004 017 854 U1.

In a further embodiment of the invention, the recess is ventilated, preferably through an intermittent weld seam.

The material of the cover plate is preferably hardened and tempered steel which preferably has the same or a higher carbon content than the guide bar base body. Expediently, the material of the cover plate has a degree of hardness of 20 to 58 HRC; a carbon content of 0.25% to 1% is advantageous. The material is especially 50 CrMo4.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
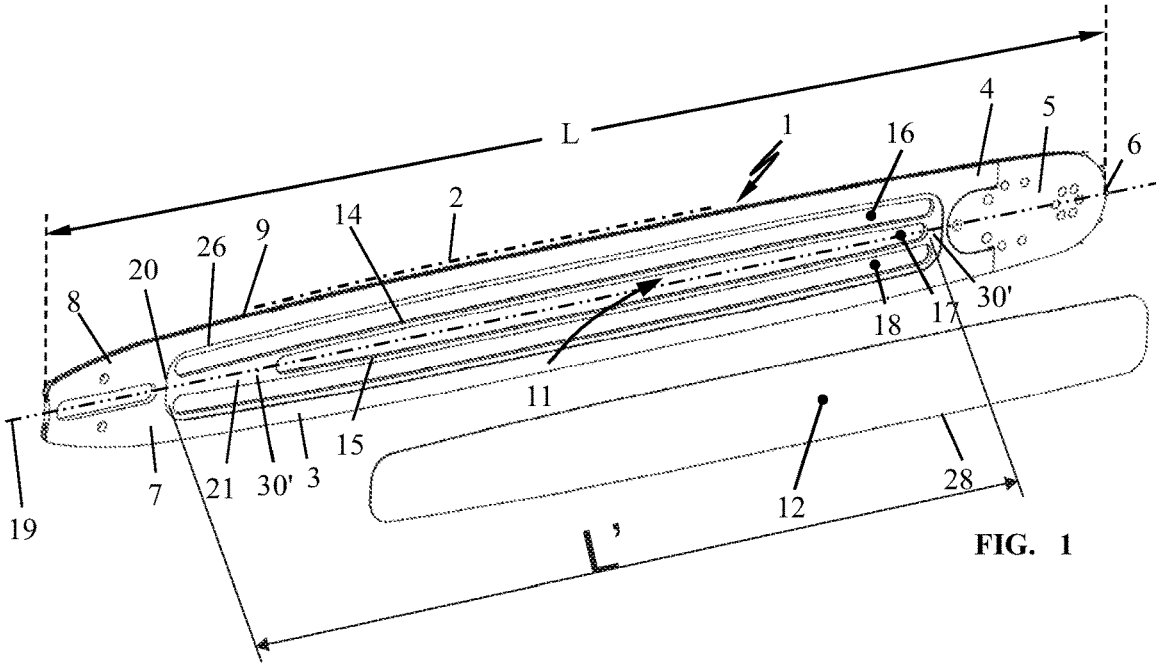
FIG. 1 is a perspective view of a guide bar of solid material with a weight recess and a corresponding cover plate.

The guide bar 1 shown in FIG. 1 serves to guide a saw chain 2 on a motor-driven chain saw. The guide bar 1 includes an elongated guide bar base body 3 having the length L with a direction reversal section 5 for the saw chain 2 provided at one end 4. In the shown embodiment, the reversal section 5 is an attachment part with a rotatable sprocket nose 6 which engages between the links of the saw chain 2 and guides these in the area of the reversal section 5. The guide bar 1 can also be a one-part member.

At the other end 7 of the guide bar base body 3, a mounting section 8 is formed, which, in the shown embodiment, is provided as one piece with the guide bar base body 3.

The guide bar base body 3 has a guide groove 10 (FIG. 2) in its edge 9 in which guide sections of the saw chain 2 engage. In this way, the saw chain 2 is guided and held in the longitudinal direction of the guide bar 1 in the guide groove 10. The guide groove 10 continues in the reversal section 5 in the same manner as over a partial region of the mounting section 8.

The guide bar base body 3 is of solid material such as hardened and tempered steel, thus consisting of a one-part component. 50 CrMo4 is preferably used as a material. This leads to a rigid and strong guide bar 1 which is provided with a weight recess 11 in order to reduce weight. The weight recess 11 essentially extends along the guide bar base body 3 between the mounting section 8 and the reversal section 5 over more than half the length of the guide bar base body 3. In the shown embodiment, the weight recess 11 essentially extends from the mounting section 8 to the reversal section 5.

Figure 2:
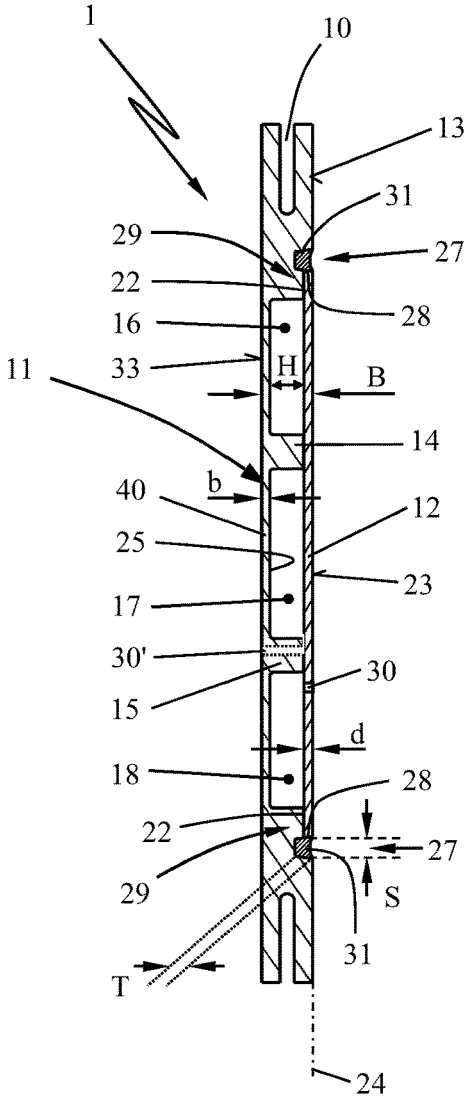
FIG. 2 is a section view through a guide bar with a cover plate being fixed in the weight recess via a weld seam; and, FIG. 3 is a view of the mounting section 8 with a connection seam 31 having partial interruption 99.

The weight recess 11 is closed by a cover plate 12 which, as shown in FIG. 2, is fixed flush with a flat side 13 on the guide bar base body 3 in a countersink 22 of the flat side 13.

The weight recess 11 is a trough-like recess with a rectangular cross section and is open only toward one flat side 13 of the guide bar base body 3. In order to support the cover plate 12 over its width, at least one longitudinal rib 14 is provided in the weight recess 11. In the shown embodiment, two longitudinal ribs (14, 15) are provided in the weight recess 11 and lie within the peripheral edge 26 of weight recess 11. The longitudinal ribs (14, 15) are formed integrally with the guide bar base body 3 as shown by the common hatching in FIG. 2. The two ribs (14, 15) essentially extend over the entire length of the weight recess 11 in the longitudinal direction 19 of the guide bar 1; thus, the weight recess is divided into a plurality of component recesses (16, 17, 18) extending in the longitudinal direction of the guide bar base body 3, so that a plurality of component recesses lie adjacent to each other transversely to the longitudinal direction of the guide bar base body 3. In the shown embodiment, three component recesses (16, 17, 18) are adjacent to each other.

The weight recess 11 of the guide bar base body 3 is hollow and clear of fillings, inserts or the like. As FIG. 2 shows, each of the component recesses (16, 17, 18) of the weight recess 11 is hollow and clear of fillings, inserts or the like. The component recesses (16, 17, 18) closed by the cover plate 12 remain hollow. Only air is present in the closed weight recesses (16, 17, 18). The height H of the component recesses (16, 17, 18) is greater than 50% of the overall thickness B of the guide bar 1. As shown in FIG. 2, the height H is selected to be approximately 70% of the thickness B of the guide bar 1.

As FIG. 1 shows, the component recesses 16 and 18 have approximately the same length and the same size while the component recess 17 formed between the longitudinal ribs 14 and 15 is shorter and smaller. The longitudinal ribs 14 and 15 merge before the end 20 of the weight recess 11 at the mounting section 8 into a joint support section 21. This is advantageous for force transmission in the area of the mounting section 8.

As FIG. 2 shows, the edge 28 of the weight recess 11 is reduced by the thickness (d) of the cover plate 12, so that the cover plate 12 lies in a countersink 22 and the outer side 23 of the cover plate 12 and the flat side 13 of the guide bar base body 3 define a common plane 24. As FIG. 2 shows, the longitudinal ribs 14 and 15 vertically extend from the bottom 25 of the weight recess 11 to the cover plate 12, so that a support of the cover plate 12 is also ensured when force is applied from outside.

As FIG. 2 further shows, the back wall 40 defining the bottom 25 has a thickness (b) and the cover plate 12 has a thickness (d). The guide bar is so configured that the thickness (b) of the back wall 40 corresponds to the thickness (d) of the cover plate 12. The guide bar has a thickness B between the first outer side 33 and the second outer side 23.

As also shown by FIG. 2, the thickness (b) of the back wall 40 and the thickness (d) of the cover plate 12 correspond to less than 20% of the thickness B of the guide bar. In the embodiment shown, the thickness (b) of the back wall 40 and the thickness (d) of the cover plate 12 are selected to be 15% of the overall thickness B of the guide bar 1.

Figure 3:
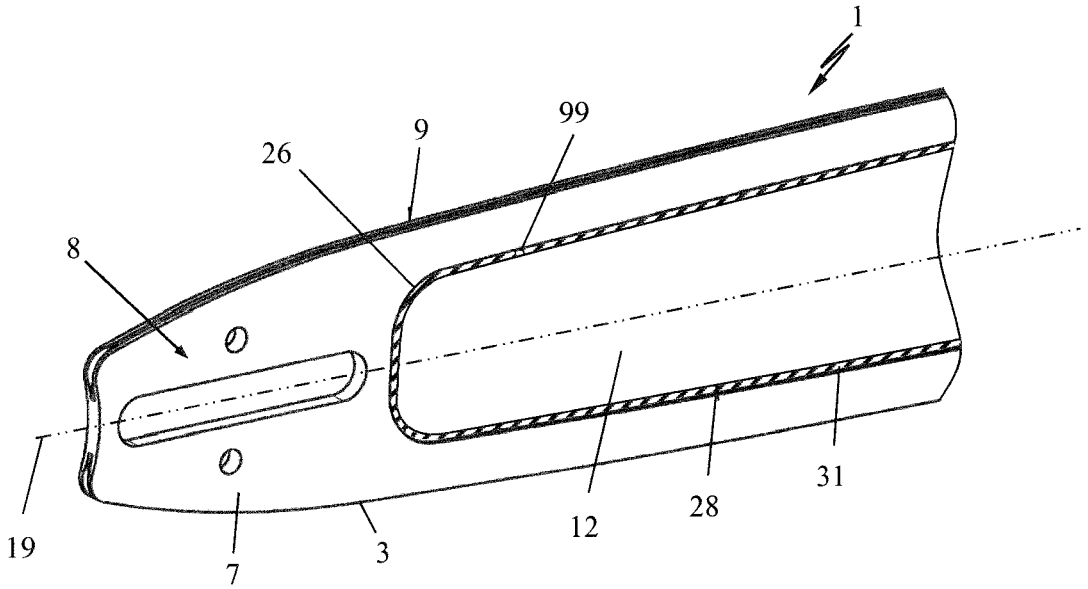

The edge 28 of the cover plate 12 is located in the countersink 22 of the guide bar base body 3 at a distance S from the peripheral edge 26 of the weight recess 11, so that there results a peripheral gap 27 between the edge 28 of the cover plate 12 and the peripheral edge 26 of the countersink 22. The supporting surface 29 of the cover plate 12 in the countersink 22 is larger transversely to the longitudinal direction 19 of the guide bar base body 3 than the width S of the gap 27, so that complete covering of the component recesses 16, 17 and 18 is invariably ensured independently of the position of the cover plate 12 in the countersink 22. The hollow spaces created by the weight recess 11 are ventilated; this can be provided by ventilating openings 30 or by a partially interrupted connecting seam 31 by which the cover plate 12 is fixed in the countersink 22 of the guide bar base body 3. The connecting seam is interrupted as shown in FIG. 3 by the interruptions indicated by reference numeral 99. The ventilation is preferably closed upon completion of the guide bar 1, for example, by a plug or the like.

Ventilating bores are also provided in the guide bar base body and are indicated by dots 30' near the longitudinal center line 19. One of these openings 30' is shown in section in FIG. 2.

The bore 30' formed in the bar base body 3 communicates with the hollow weight recess 18 via the interface between cover 12 and ribs 15 for venting the hollow weight recess.

The bore 30' has a bore width measured in the direction from the first end of the guide bar to the second end thereof and the hollow weight recess 18 has a weight recess length L' measured in a direction from the first end of the guide bar to the second end thereof. The bore width is less than 5% of the weight recess length as can be seen from a comparison of FIGS. 1 and 2.

As FIG. 2 shows, the connecting seam 31 fills the gap 27 almost completely. The connecting seam can be formed by hard soldering, adhesive bonding, welding, or the like. In a preferred embodiment, the connecting seam is produced by laser welding. Bifocal laser welding as disclosed in DE 20 2004 017 854 U1 is particularly suited for this. A good connection without warping can be produced by this method. The laser beams liquefy the peripheral edge 28 of the cover plate 12 as well as the edge 26 of the countersink 22, whereby the welding seam fills and/or bridges the peripheral gap 27. As FIG. 2 shows, a welding seam 31 forms in the gap 27 and is thicker than the depth of the countersink 22. The thickness T of the welding seam 31 preferably corresponds to about twice to three times the thickness (d) of the cover plate 12. The cover plate 12 has a thickness (d) of about 0.5 mm to 1 mm, preferably 0.75 mm.

The guide bar base body 3 is a high-quality hardened and tempered steel, preferably 50CrMo4. The cover plate 12 is made of steel having a degree of hardness of 20 to 58 HRC Rockwell hardness number; the material preferably has a carbon content in the range of 0.25% to 1%. In a further embodiment of the invention, the cover plate 12 is made of hardened and tempered steel which, according to the invention, has a higher carbon content than the guide bar base body 3. In particular, the cover plate 12 consists of a hardened and tempered steel 50CrMo4. It can be practical to design the cover plate of the same material as the guide bar base body.

It is understood that the foregoing description is that of the preferred embodiments of the invention and that various changes and modifications may be made thereto without departing from the spirit and scope of the invention as defined in the appended claims.

What is claimed is:

1. A guide bar for a saw chain of a motor driven chain saw, the guide bar comprising:

an elongated bar base body of solid material having a first end and a second end;

a direction reversal section for said saw chain and said direction reversal section being arranged at said first end of said bar base body;

a mounting section for fixating said guide bar and said mounting section being arranged at said second end;

said bar base body defining an outer peripheral edge and having first and second flat sides;

a guide groove formed in said outer peripheral edge of said bar base body and being configured to guide said saw chain;

a hollow weight recess formed in said first flat side of said bar base body and said hollow weight recess extending along said bar base body between said mounting section and said reversal section;

said hollow weight recess having a peripheral edge and being configured as a trough recess having a bottom defined by and being integral with said solid material of said bar base body;

said hollow weight recess being open only to said first flat side;

a cover plate for closing said hollow weight recess;

said hollow weight recess having a longitudinal rib arranged therein and said longitudinal rib being formed integrally with said bar base body;

said longitudinal rib extending in the longitudinal direction of said bar base body over the entire length of said hollow weight recess so as to partition said hollow weight recess into component hollow weight recesses extending in said longitudinal direction of said elongated bar base body;

said longitudinal rib extending from said bottom of said hollow weight recess to said cover plate;

said longitudinal rib supporting said cover plate also when force is applied from the outside;

said cover plate having an edge;

said edge of said cover plate being located at a distance from said peripheral edge of said hollow weight recess so that said edge of said cover plate and said peripheral edge of said hollow weight recess conjointly define a peripheral gap;

a weld seam disposed in said gap and fixing said cover plate to said bar base body; and, said weld seam being a weld seam made of material of said peripheral edge of said weight recess and said edge of said cover plate.

2. The guide bar of claim 1, wherein said weld seam has an interruption formed therein to permit said hollow weight recess to be ventilated through said interruption.

3. A guide bar for a saw chain of a motor driven chain saw, the guide bar comprising:

an elongated bar base body of solid material having a first end and a second end;

a direction reversal section for said saw chain and said direction reversal section being arranged at said first end of said bar base body;

a mounting section for fixating said guide bar and said mounting section being arranged at said second end;

said bar base body defining an edge and having a flat side;

a guide groove formed in said edge of said bar base body and being configured to guide said saw chain;

a hollow weight recess formed down to a bottom thereof in said flat side of said bar base body and said hollow weight recess extending essentially along said bar base body between said mounting section and said reversal section;

a cover plate for closing said hollow weight recess;

said hollow weight recess having a longitudinal rib arranged therein and said longitudinal rib extending in the longitudinal direction of said bar base body;

said bar base body and said cover plate conjointly defining a weld gap therebetween;

a weld seam fixing said cover plate to said bar base body;

said weld seam filling said gap and being a weld seam consisting of material of said bar base body and said cover plate;

the material of said cover plate having a degree of hardness of 20 to 58 HRC and a carbon content between 0.25% and 1%;

said material of said cover plate being a hardened and tempered steel; and, said material of said cover plate having a carbon content at least as high as the carbon content of said bar base body.

4. The guide bar of claim 3, wherein said cover plate consists essentially of 50CrMo4.

5. The guide bar of claim 3, wherein said cover plate and said bar base body are made of the same material.

6. A guide bar for a saw chain of a motor driven chain saw, the guide bar comprising:

an elongated bar base body of solid material having a first end and a second end;

a direction reversal section for said saw chain and said direction reversal section being arranged at said first end of said bar base body;

a mounting section for fixating said guide bar and said mounting section being arranged at said second end;

said bar base body defining an edge and having a flat side;

a guide groove formed in said edge of said bar base body and being configured to guide said saw chain;

a hollow weight recess formed down to a bottom thereof in said flat side of said bar base body and extending essentially along said bar base body between said mounting section and said reversal section;

a cover plate for closing said hollow weight recess;

said hollow weight recess having a longitudinal rib arranged therein for supporting said cover plate and said longitudinal rib extending in the longitudinal direction of said bar base body;

said cover plate having an edge;

said hollow weight recess having a peripheral edge;

said edge of said cover plate being located at a distance from said peripheral edge of said hollow weight recess so that said edge of said cover plate and said peripheral edge of said hollow weight recess conjointly define a gap;

said cover plate being fixed on said bar base body with a weld seam filling said gap; and, said weld seam being a weld seam formed with material of said peripheral edge of said weight recess and of said edge of said cover plate.

7. The guide bar of claim 6, wherein said cover plate and said bar base body are made of the same material.

8. The guide bar of claim 6, wherein said bottom of said hollow weight recess is part of a back wall which has a thickness (b) equal to the thickness of said cover plate.

9. The guide bar of claim 8, wherein said guide bar has a thickness (B); and, said thickness (b) of said back wall is less than 20% of said thickness (B) of the guide bar.

10. The guide bar of claim 6, wherein the hollow weight recess is free of any insert.

11. A guide bar for a saw chain of a motor driven chain saw, the guide bar comprising:

an elongated bar base body of solid material having a first end and a second end;

a direction reversal section for said saw chain and said direction reversal section being arranged at said first end of said bar base body;

a mounting section for fixating said guide bar and said mounting section being arranged at said second end;

said bar base body defining an edge and having a flat side;

a guide groove formed in said edge of said bar base body and being configured to guide said saw chain;

a hollow weight recess formed down to a bottom thereof in said flat side of said bar base body and extending essentially along said bar base body between said mounting section and said reversal section;

a cover plate for closing said hollow weight recess;

said hollow weight recess having a longitudinal rib arranged therein for supporting said cover plate and said longitudinal rib extending in the longitudinal direction of said bar base body;

said cover plate having an edge;

said hollow weight recess having a peripheral edge;

said edge of said cover plate and said peripheral edge of said hollow weight recess conjointly defining a gap therebetween;

the material of said cover plate having a degree of hardness of 20 to 58 HRC and a carbon content between 0.25% and 1%;

said material of said cover plate being a hardened and tempered steel;

said material of said cover plate having a carbon content at least as high as the carbon content of said bar base body;

said cover plate being fixed on said bar base body with a weld seam filling said gap and said weld seam being formed of material of said cover plate and said peripheral edge of said hollow weight recess; and, wherein said weld seam has an interruption formed therein to permit said hollow weight recess to be ventilated through said interruption.

* * * * *